United States Patent [19]

Gruenwald

[11] 3,979,776

[45] Sept. 14, 1976

[54] DISPOSABLE BIB

[75] Inventor: Nancy K. Gruenwald, Libertyville, Ill.

[73] Assignee: Lawrence Peska Associates, Inc., New York, N.Y. ; a part interest

[22] Filed: May 5, 1975

[21] Appl. No.: 574,762

[52] U.S. Cl. ..... 2/49 R
[51] Int. Cl.[2] ..... A41B 13/10
[58] Field of Search ..... 2/49 R, 52

[56] References Cited

UNITED STATES PATENTS

| | | | |
|---|---|---|---|
| 2,571,888 | 10/1951 | Jesse | 2/49 R |
| 2,902,734 | 9/1959 | Walters | 2/49 R X |
| 3,299,440 | 1/1967 | Grable | 2/49 R |
| 3,540,060 | 11/1970 | Brown | 2/49 R |
| 3,871,027 | 3/1975 | Orr | 2/49 R |

FOREIGN PATENTS OR APPLICATIONS

| | | | |
|---|---|---|---|
| 1,561,262 | 2/1969 | France | 2/49 R |
| 1,095,397 | 12/1967 | United Kingdom | 2/49 R |

*Primary Examiner*—Alfred R. Guest
*Attorney, Agent, or Firm*—Richard Enanfeldt

[57] ABSTRACT

A disposable bib is secured onto the shoulders of a baby, wherein the bib covers the chest and abdomen of the baby. The bib consists of an elongated, substantially rectangular sheet, wherein a U-shaped cut out is contained along the upper edge of the sheet. The sheet is formed from a composite of three layers, wherein the layers are: a back thermoplastic film layer, a middle absorbent layer such as cellulosic wadding, and a front paper-like layer.

5 Claims, 3 Drawing Figures

FIG. 1
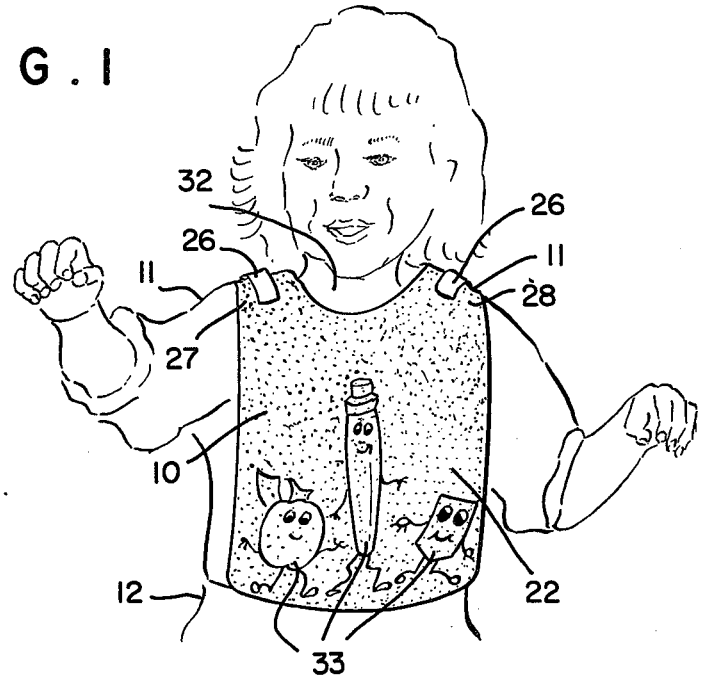
FIG. 2
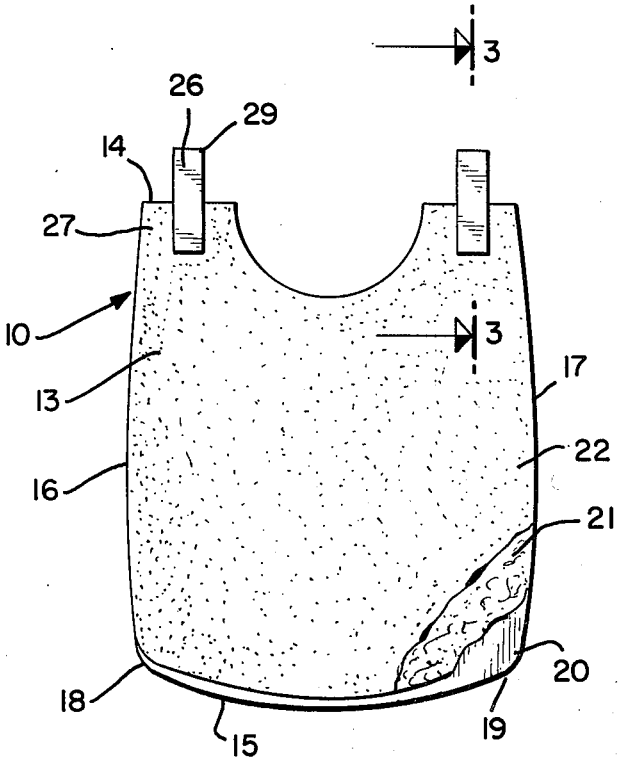
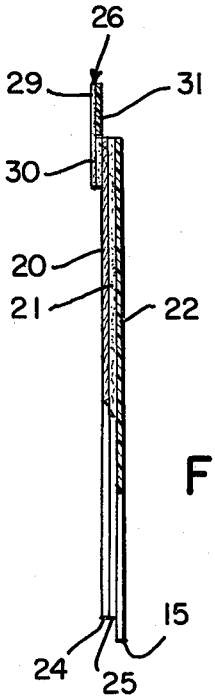
FIG. 3

DISPOSABLE BIB

SUMMARY OF THE INVENTION

My present invention relates to a unique and novel disposable bib secured onto the shoulders of a user such as a baby, wherein the bib covers the chest and abdomen areas of the user.

U.S. Pat. Nos. 3,452,363; and 3,583,558; have been employed as disposable bibs, but these aforementioned patents involve methods of securing the bib around the user's neck which is non-applicable to my present invention.

Accordingly, it is an object of my present invention to provide a means for securing a disposable bib to a user, wherein the bib does not encircle the whole neck.

Another object of my present invention is to provide a generally rectangular shaped bib formed from a composite of a thermoplastic film back layer, an absorbent middle layer, and a paper-like front layer.

Briefly, my present invention comprises an elongated substantially rectangular sheet, wherein a U-shaped cut out is contained along the upper edge of the sheet. The sheet is formed from a composite of three layers, wherein the layers are: a back thermoplastic film layer, a middle absorbent layer such as cellulosic wadding, and a front paper-like layer.

BRIEF DESCRIPTION OF THE DRAWINGS

The objects and features of the invention may be understood with reference to the following detailed description of an illustrative embodiment of the invention, taken together with the accompanying drawings in which:

FIG. 1 illustrates a front view of a disposable bib in use on a baby;

FIG. 2 ilustrates a front cutaway view of the disposable bib taken along line 3—3 of FIG. 3; and FIG. 3 illustrates a side view of the disposable bib.

DESCRIPTION OF THE PREFERRED EMBODIMENT

Turning now descriptively to the drawings, in which similar reference characters denote similar elements throughout the several views, FIG. 1 shows a disposable bib 10 secured onto the shoulders 11 of a baby 12. Clearly, although the bib 10 is illustrated for use with a baby 12, the bib 10 could be of larger dimensions for an adult's use such as in the case of eating lobsters.

As shown in FIGS. 2, 3 the disposable bib 10 is an elongated, substantially rectangular sheet 13 having an upper edge 14, a lower edge 15, and a pair of parallel side edges 16, 17. The bottom corners 18, 19 of the bib 10 are rounded off in a smooth broad radii. At the midpoint of the upper edge 14 is a substantially U-shaped cutout 23, wherein the cutout 23 extends longitudinally downward into sheet 13. The sheet 13 is formed from a composite of three layers 20, 21, 22, wherein the back layer 20 is a thermoplastic film, the middle layer 21 is an absorbent material, and the front layer 22 is a paper like substance. The paper like front layer 22 has a wet strength treatment incorporated therein, wherein the paper like front layer 22 is of a known composition to allow the passing of moisture and liquids into the middle absorbent layer 21. The middle layer 21 and front layer 22 are secured together usually by appropriate adhesive means, however, other suitable means can equally be employed. The primary function of the front layer 22 is to serve as a semi-protective barrier against the middle absorbent layer 21 mechanically disentergrating upon becoming wet. The middle absorbent layer 22 is usually formed from multiple plies of a cellulose wadding; however, suitable materials such as synthetic fibers as well as natural occuring fibers can readily be employed. The back layer 20 is formed from a thermoplastic film usually 0.5 to 1.5 mils in thickness; however, thicker films can be readily employed. The thermoplastic film is selected from a group consisting of polyethylene, polypropylene, polyvinyl chloride, polyvinyl acetate, nylon, polyesters, polyethylene vinyl acetate, polyethylene methyl methacrylate, polyethylene acrylic acid, polypropylene methylmethacrylate, polypropylene acrylic, acid, polyvinyliliene chloride, polyvinyl alcohol, cellulose acetate, cellulose butyrate, polycarbonates, and alkyd cellulosics, wherein the aforementioned polymers are to be considered only as illustrative in purpose. The thermoplastic back layer 20 is secured to the absorbent middle layers by a number of various means such as: laminating, embossing, extrusion coating, or adhesive means. The width of the front 22 and middle 21 layers are substantially equal to that of the back thermoplastic layer; however the longitudinal length of the back thermoplastic layer 22 is greater than the longitudinal length of the front 22 and middle layers. The upper edges of the three layers 20, 21, 22 coincide together to form the upper edge 14 of the sheet 13. The bottom edge of the back thermoplastic layer 20 extends below the bottom edges 24, 25 of the middle 21 and front 22 layers to form the lower edge 15 of the sheet 13. Adhesive tape members 26 are affixed onto the upper left 27 and right 28 hand corners of the front paper like layer 22 of the sheet 13, wherein the free ends 29 of each adhesive tape member 26 extends outwardly from the upper edge 14 of the sheet. A peel off paper backing 30 is contained on the adhesive back face 31 of the free ends 29 of each adhesive tape member 26.

Referring back to FIG. 1, the cut out 23 of the bib 10 abutts the front portion of the neck 32 of the baby 12, wherein the adhesive tap members 26 secure onto the shoulders 11 of the baby 12, such that the back thermoplastic layer 22 lays flat against the chest and abdomen of the baby 12. A plurality of designs 33 such as animals are printed on the front paperlike layer 22.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A disposable bib, which comprises an elongated substantially rectangularly shaped sheet formed from three layers, a middle portion of an upper edge of said sheet having a u-shaped cutout therein, said three layers consisting of a thermoplastic back layer formed from a film, a middle cellulosic absorbent wadding layer, and a front layer formed from a paper like material, a lower edge of said thermoplastic layer extending below the lower edges of said front and middle layers, said middle layer joined to said front and back by adhesive means, and an adhesive tab member affixed onto said paper like layer at an upper right and left corners of said sheet, each said tab member extending beyond the top edge of said sheet.

2. A disposable bib as recited in claim 1, wherein said back thermoplastic layer is polyethylene.

3. A disposable bib as recited in claim 1, wherein said back thermoplastic layer is polyvinyl chloride.

4. A disposable bib as recited in claim 1, wherein said back thermoplastic layer is nylon.

5. A diposable bib as recited in claim 1, wherein said back thermoplastic layer is polyester.

* * * * *